US009605545B2

(12) United States Patent
Grohens et al.

(10) Patent No.: US 9,605,545 B2
(45) Date of Patent: Mar. 28, 2017

(54) GAS TURBINE BLADE WITH TIP SECTIONS OFFSET TOWARDS THE PRESSURE SIDE AND WITH COOLING CHANNELS

(71) Applicant: SNECMA, Paris (FR)

(72) Inventors: Regis Grohens, Tournan en Brie (FR); Erwan Daniel Botrel, Alfortville (FR)

(73) Assignee: SNECMA, Paris (FR)

( * ) Notice: Subject to any disclaimer, the term of this patent is extended or adjusted under 35 U.S.C. 154(b) by 379 days.

(21) Appl. No.: 14/358,851

(22) PCT Filed: Nov. 13, 2012

(86) PCT No.: PCT/FR2012/052604
§ 371 (c)(1),
(2) Date: May 16, 2014

(87) PCT Pub. No.: WO2013/072610
PCT Pub. Date: May 23, 2013

(65) Prior Publication Data

US 2014/0322028 A1 Oct. 30, 2014

(30) Foreign Application Priority Data

Nov. 17, 2011 (FR) ..... 1160465

(51) Int. Cl.
*F01D 5/20* (2006.01)
*F01D 5/18* (2006.01)
(Continued)

(52) U.S. Cl.
CPC ..... *F01D 5/186* (2013.01); *F01D 5/141* (2013.01); *F01D 5/187* (2013.01); *F01D 5/20* (2013.01); *F01D 5/18* (2013.01)

(58) Field of Classification Search
CPC ..... F01D 5/186; F01D 5/141; F01D 5/187; F01D 5/20; F01D 5/18; F05D 2260/20
(Continued)

(56) References Cited

U.S. PATENT DOCUMENTS 6,672,829 B1 * 1/2004 Cherry ..... F01D 5/141 415/115
2004/0013515 A1 1/2004 Cherry et al.
(Continued)

FOREIGN PATENT DOCUMENTS

EP 1 762 702 3/2007

OTHER PUBLICATIONS

International Search Report Issued Feb. 18, 2013 in PCT/FR12/052604 Filed Nov. 13, 2012.

*Primary Examiner* — Kevin Murphy
*Assistant Examiner* — Kelsey Rohman
(74) *Attorney, Agent, or Firm* — Oblon, McClelland, Maier & Neustadt, L.L.P.

(57) ABSTRACT

A hollow blade including an airfoil extending along a longitudinal direction, a root, a tip, an internal cooling passage, and an open cavity defined by an end wall and a rim, together with cooling channels connecting the internal cooling passage to a pressure side. The cooling channels slope relative to the pressure side. A stack of airfoil sections of the blade at a level of the rim of the tip of the blade are offset towards the pressure side. The pressure side wall of the airfoil includes a projecting portion and cooling channels arranged in the projecting portion to open out into a terminal face of the projecting portion.

15 Claims, 4 Drawing Sheets

(51) Int. Cl.

| | |
|---|---|
| ***F03D 11/02*** | (2006.01) |
| ***F03B 3/12*** | (2006.01) |
| ***F03B 7/00*** | (2006.01) |
| ***F04D 29/08*** | (2006.01) |
| ***F03B 11/00*** | (2006.01) |
| ***F01D 11/08*** | (2006.01) |
| ***F03D 11/00*** | (2006.01) |
| ***F01D 5/14*** | (2006.01) |

(58) Field of Classification Search
USPC ..... 416/97 R, 232; 415/115, 173.1
See application file for complete search history.

(56) References Cited

U.S. PATENT DOCUMENTS

| | | | | |
|---|---|---|---|---|
| 2004/0126236 | A1 | 7/2004 | Lee et al. | |
| 2007/0059173 | A1* | 3/2007 | Lee ..... | F01D 5/20 416/97 R |
| 2008/0175716 | A1* | 7/2008 | Potier ..... | F01D 5/20 416/97 R |
| 2010/0135813 | A1 | 6/2010 | Marini et al. | |

* cited by examiner

GAS TURBINE BLADE WITH TIP SECTIONS OFFSET TOWARDS THE PRESSURE SIDE AND WITH COOLING CHANNELS

BACKGROUND OF THE INVENTION

Field of the Invention

The field of the present invention relates to hollow blades, in particular gas turbine blades, and more particularly to the moving blades of turbine engines, specifically the moving blades of a high pressure turbine.

Description of the Related Art

In known manner, a blade comprises in particular an airfoil extending in a longitudinal direction, a root, and a tip opposite from the root. For a moving turbine blade, the blade is fastened to the disk of a turbine rotor by means of its root. The blade tip is situated facing the inside face of the stationary annular casing surrounding the turbine. The longitudinal direction of the airfoil corresponds to the radial direction of the rotor or of the engine, with this being relative to the axis of rotation of the rotor.

The airfoil may be subdivided into airfoil sections that are stacked in a stacking direction that is radial relative to the axis of rotation of the rotor disk. The blade sections thus build up an airfoil surface that is subjected directly to the gas passing through the turbine. From upstream to downstream in the fluid flow direction, this airfoil surface extends between a leading edge and a trailing edge, these edges being connected together by a pressure side face and a suction side face, also referred to as the pressure side and the suction side.

The turbine having such moving blades has a flow of gas passing therethrough. The aerodynamic surfaces of its blades are used for transforming a maximum amount of the kinetic energy taken from the flow of gas into mechanical energy that is transmitted to the rotary shaft of the turbine rotor.

However, like any obstacle present in a gas flow, the airfoil of the blade generates kinetic energy losses that need to be minimized. In particular, it is known that a non-negligible portion of these losses (in the range 20% to 30% of total losses) can be attributed to the presence of functional radial clearance between the tip of each blade and the inside surface of the casing surrounding the turbine. This radial clearance allows a flow of gas to leak from the pressure side of the blade (zone where pressure is higher) towards the suction side (zone where pressure is lower). This leakage flow represents a flow of gas that does no work and that does not contribute to expansion in the turbine. Furthermore, it also gives rise to turbulence at the tip of the blade (known as the tip vortex), which turbulence generates high levels of kinetic energy losses.

In order to solve that problem, it is known to modify the stacking of the sections of the blade at the level of the blade tip, in order to offset the stacking towards the pressure side face, this offset preferably taking place progressively, being more pronounced for sections that are closer to the free end of the tip.

Blades of this type are referred to as blades with an "advanced blade top" or as blades with a "tip section offset".

Furthermore, turbine blades, and in particular the moving blades of a high pressure turbine, are subjected to high temperature levels by the external gas coming from the combustion chamber. These temperature levels exceed the temperatures that can be accepted by the material from which the blade is made, thus requiring the blades to be cooled. Recently-designed engines have ever-increasing temperature levels for the purpose of improving overall performance, and these temperatures make it necessary to install innovative cooling systems for the high pressure turbine blades in order to ensure that these parts have a lifetime that is acceptable.

The hottest location in a moving blade is its tip, so cooling systems seek firstly to cool the top of the blade.

A wide variety of techniques have already been proposed for cooling blade tips, and mention may be made in particular to those described in EP 1 505 258, FR 2 891 003, and EP 1 726 783.

Consequently, it can be understood that the particular configuration that arises when using the "tip section offset" technique disturbs the performance and the effectiveness of conventional cooling systems in the tip zone of the blade.

Unfortunately, the top of a blade is always the hottest location of a moving blade, so it is essential for the "tip section offset" technique to be capable of coexisting with a cooling system that remains effective in order to conserve a lifetime for the part in this zone that is sufficient when subjected to high temperature conditions upstream.

It is found that those solutions are not compatible with the "tip section offset" technique.

BRIEF SUMMARY OF THE INVENTION

An object of the present invention is thus to propose a blade structure that makes it possible to conserve high effectiveness of the cooling system at the top of a blade, even when the blade has an advanced top of the "tip section offset" type.

To this end, the present invention relates to a hollow blade having an airfoil extending along a longitudinal direction, a root, and a tip, an internal cooling passage inside the airfoil, a cavity (or "bathtub") situated in the tip, being open towards the free end of the blade and defined by an end wall and a rim, said rim extending between the leading edge and the trailing edge and comprising a suction side rim along the suction side and a pressure side rim along the pressure side, and cooling channels connecting said internal cooling passage with the pressure side, said cooling channels sloping relative to the pressure side, the stack of airfoil sections of the blade at the level of the rim of the blade tip presenting an offset towards the pressure side, this offset increasing on approaching the free end of the tip of the blade.

This hollow blade is characterized in that the pressure side wall of the airfoil presents a projecting portion with more than half of its length extending along a longitudinal portion of the internal cooling passage, and with an outside face that slopes relative to the remainder of the pressure side of the airfoil, and presenting a terminal face at its end facing towards the cavity, the end wall being connected to the pressure side wall at the location of said end of the projecting portion and said cooling channels being arranged in said projecting portion in such a manner as to open out in the terminal face of said projecting portion, whereby the distance $\underline{d}$ between the axes of the cooling channels and the outer limit A of the free end of the pressure side rim is greater than or equal to a non-zero minimum value d1. This value d1 thus corresponds to a threshold value that is predetermined depending on the type of blade and on the operating conditions that apply to drilling the channels.

Overall, by means of the solution of the present invention, the position of the pressure side wall portion that includes the cooling channels is offset towards the pressure side so as to enable drilling tools to access the appropriate location, while not degrading the performance of the cooling, and possibly even while improving it.

This solution also presents the additional advantage of making it possible to further improve the cooling of the pressure side wall portion carrying the cooling channels by means of thermal pumping so as to obtain better film cooling of the pressure side rim of the cavity (or bathtub).

The present invention also provides a turbine engine rotor, a turbine engine turbine, and a turbine engine including at least one blade as defined in the present specification.

BRIEF DESCRIPTION OF THE SEVERAL VIEWS OF THE DRAWINGS

Other advantages and characteristics of the invention appear on reading the following description made by way of example and with reference to the accompanying drawings, in which.

DETAILED DESCRIPTION OF THE INVENTION

In the present application, unless specified to the contrary, upstream and downstream are defined relative to the normal flow direction of gas through the turbine engine (from upstream to downstream). Furthermore, the term "axis of the engine" is used to designate the axis X-X' of radial symmetry of the engine. The axial direction corresponds to the direction of the axis of the engine, and a radial direction is a direction perpendicular to said axis and intersecting it. Likewise, an axial plane is a plane containing the axis of the engine, and a radial plane is a plane perpendicular to said axis and intersecting it. The transverse (or circumferential) direction is a direction perpendicular to the axis of the engine and not intersecting it. Unless specified to the contrary, the adjectives axial, radial, and transverse (and the adverbs axially, radially, and transversely) are used relative to the above-specified axial, radial, and transverse directions. Finally, unless specified to the contrary, the adjectives inner and outer are used relative to the radial direction such that an inner (i.e. radially inner) portion or face of an element is closer to the axis of the engine than is an outer (i.e. radially outer) portion or face of the same element.

Figure 1:
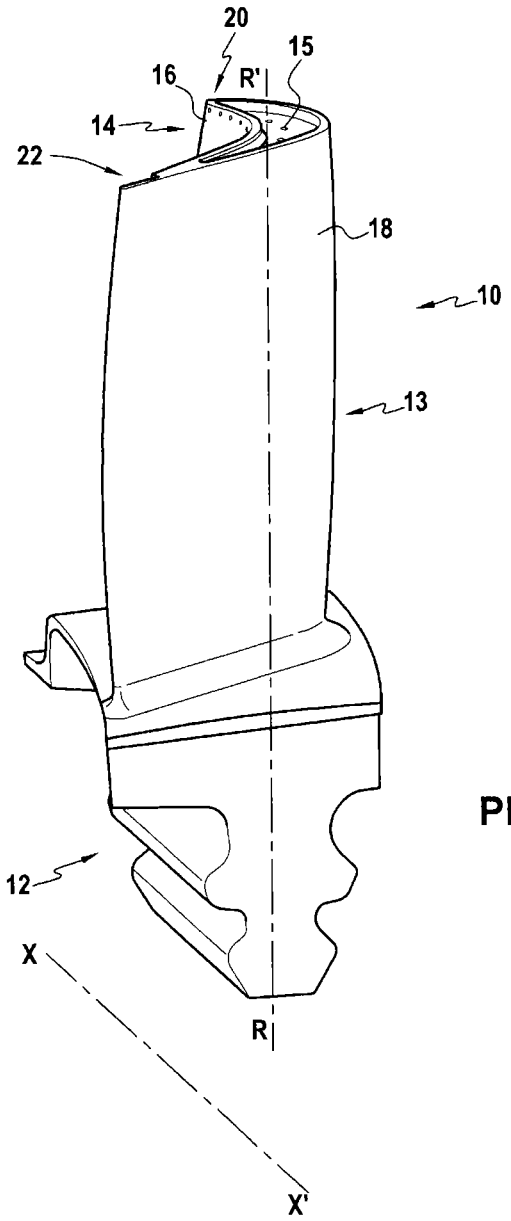
FIG.1 PRIOR ART
FIG. 1 is a perspective view of a conventional hollow rotor blade for a gas turbine.

FIG. 1 is a perspective view of an example of a conventional hollow rotor blade 10 for a gas turbine. Cooling air (not shown) flows inside the blade from the bottom of the root 12 of the blade, along the airfoil 13, in a longitudinal direction R-R' of the blade 13 (the vertical direction in the figure and the radial direction relative to the axis of rotation X-X' of the rotor), towards the tip 14 of the blade (at the top in FIG. 1), and this cooling air then escapes via an outlet to join the main gas stream.

In particular, this cooling air flows in an internal cooling passage situated inside the blade and terminating at the tip 14 of the blade in through holes 15.

The body of the blade is profiled so as to define a pressure side wall 16 (to the left in all of the figures) and a suction side wall 18 (to the right in all of the figures).

The pressure side wall 16 is generally concave in shape and it is the first wall encountered by the hot gas stream, i.e. its outside face facing upstream is on the gas pressure side and is referred to as the "pressure side face" or more simply as the "pressure side" 16*a*.

The suction side wall 18 is convex and encounters the hot gas stream subsequently, i.e. it is on the gas suction side along its outer face that faces downstream and referred to as the "suction side face" or more simply as the "suction side" 18*a*.

The pressure and suction side walls 16 and 18 meet at a leading edge 20 and at a trailing edge 22 that extend radially between the tip 14 of the blade and the top of the root 12 of the blade.

Figure 2:
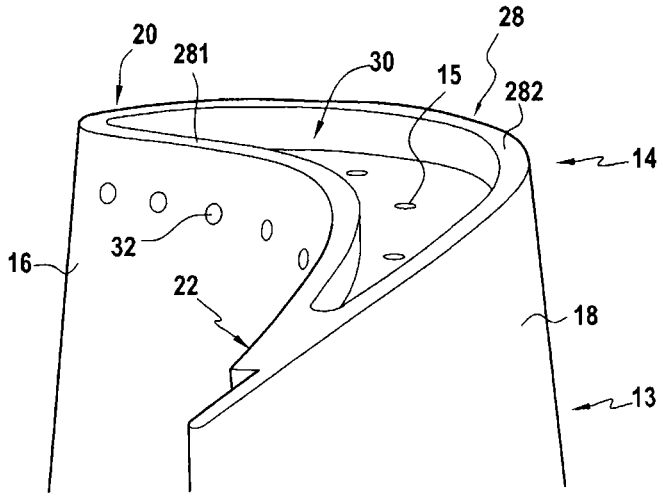
FIG.2 PRIOR ART
FIG. 2 is a perspective view on a larger scale of the free end of the FIG. 1 blade.
Figure 3:
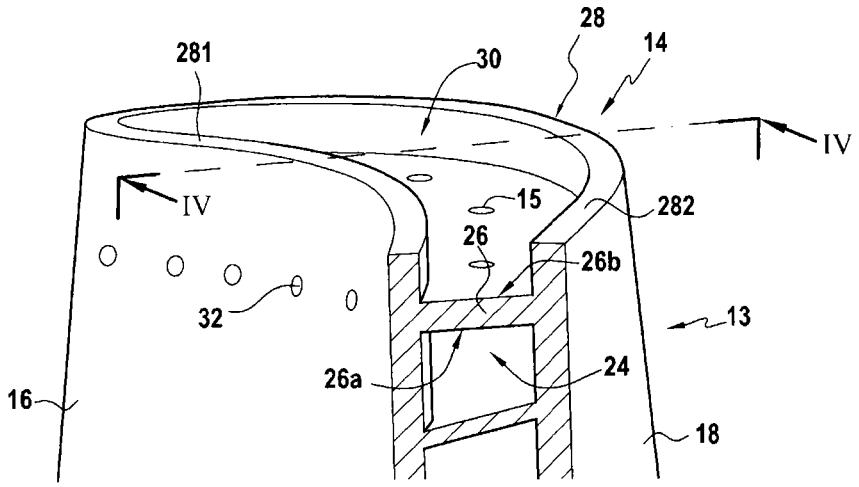
FIG.3 PRIOR ART
FIG. 3 is a view analogous to the view of FIG. 2, but partially in longitudinal section after the trailing edge of the blade has been removed.
Figure 4:
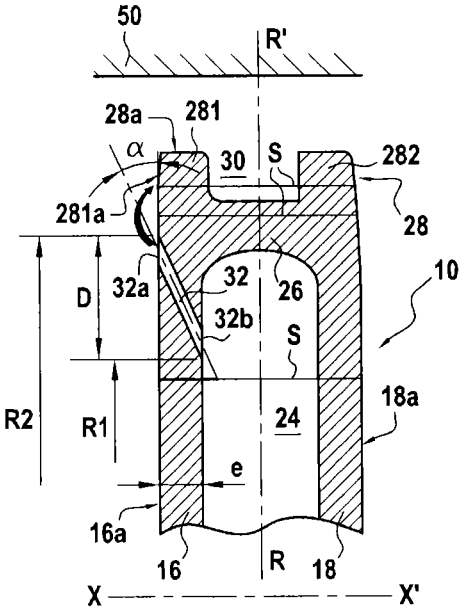
FIG.4 PRIOR ART
FIG. 4 is a fragmentary longitudinal section view on line IV-IV of FIG. 3.

As can be seen from the enlarged views of FIGS. 2 to 4, at the tip 14 of the blade, the internal cooling passage 24 is defined by the inside face 26*a* of an end wall 26 that extends over the entire tip 14 of the blade between the pressure side wall 16 and the suction side wall 18, and thus from the leading edge 20 to the trailing edge 22.

At the tip 14 of the blade, the pressure and suction side walls 16 and 18 form a rim 28 of a cavity 30 that is open facing away from the internal cooling passage 24, i.e. radially outwards (upwards in all of the figures). More precisely, the rim 28 is constituted by a pressure side rim 281 beside the pressure side wall 16 and a suction side rim 282 beside the suction side wall 18.

As can be seen in the figures, this open cavity 30 is thus defined laterally by the inner face of the rim 28 and in its low portion by the outer face 26*b* of the end wall 26.

The rim 28 thus forms a thin wall along the profile of the blade that protects the free end of the tip 14 of the blade 10 from making contact with the corresponding inner annular surface of the turbine casing 50 (see FIG. 4).

As can be seen more clearly in the section view of FIG. 4, which shows the prior art cooling technology involving holes under the bathtub, sloping cooling channels 32 pass through the pressure side wall 16 in order to connect the internal cooling passage 24 to the outside face of the pressure side wall 16, i.e. the pressure side 16*a*.

These cooling channels 32 slope so as to open out towards the top 28*a* of the rim in order to cool it by means of a jet of air that goes towards the top 28*a* of the rim 28 along the pressure side wall 16.

The effectiveness of the cooling that results from these cooling channels 32 is governed mainly by two geometrical parameters of these cooling channels 32 (see FIG. 4):

the total radial extent D of the cooling channels 32 between the two radii R1 and R2 (respectively the height of the inlet opening 32*b* and the height of the outlet opening 32*a* of the cooling channels 32 in the pressure side 16); the greater this radial extent D, the more the phenomenon of cooling by thermal pumping applies to a large portion of the blade along the axis R-R'; and the height of the outlet openings 32*a* of the cooling channels 32 in the pressure side 16 specified by the radius R2 referred to as the "outlet" radius; the greater this radius R2, the more effective the external film of cooling air all the way to the top of the bathtub, i.e. the top 28*a* of the pressure side rim 281.

Finally, the industrial feasibility of making cooling channels 32 (which are generally made by electron discharge machining (EDM)), requires an angle α between the axis of the cooling channel 32 and the outside face 281*a* of the pressure side rim 281 that is sufficient to leave enough clearance to allow the EDM nozzle to pass.

Figure 5:
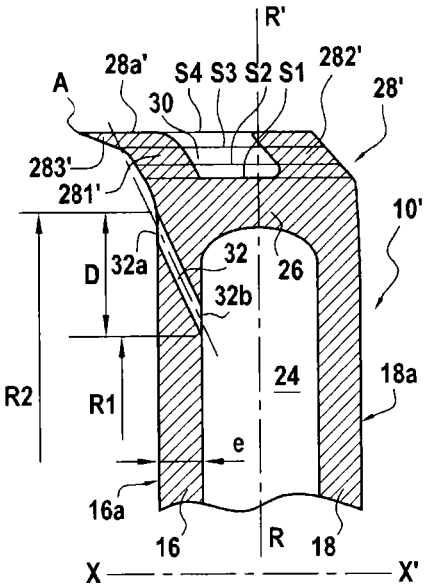
FIGS. 5 to 7 are views similar to the view of FIG. 4, for blades incorporating the "tip section offset" technique.

It can be seen that if the geometrical configuration of the cooling channel 32 in FIG. 4 is used unchanged for a blade 10' that also includes a "tip section offset" (FIG. 5), then the clearance of the axis of the cooling channel 32 (angle α) is no longer sufficient. Under such circumstances, the axis of the cooling channel 32 interferes with the pressure side rim 281', either by being too close to it or by intersecting it as shown in FIG. 5. It is thus no longer possible to make the cooling channel 32 by drilling.

In FIG. 5, the blade 10' with a "tip section offset" is given the same reference signs as those used for the blade in FIGS. 1 to 4, together with a prime symbol ("") for portions that are modified. Specifically, the differences relate solely to the shape of the rim 28' that is no longer parallel to the longitudinal direction R-R' of the blade 10', i.e. to the radial direction.

The sections S of the airfoil are considered as corresponding to the outline of the airfoil in sections on section planes that are orthogonal to the longitudinal direction R-R' of the blade, i.e. the radial direction. For the blade 10, all of the airfoil sections S are stacked in a stacking direction parallel to the longitudinal direction R-R' of the blade, i.e. the radial direction, the sections being superposed on one another (see FIG. 4).

For the blade 10' in FIG. 5, the airfoil sections S of the airfoil portion including the internal cooling passage 24 and the end wall 26 are likewise stacked in the radial direction of the blade; nevertheless, the airfoil sections S1, S2, S3, and S4 of the rim 28' (i.e. the tip sections) are stacked so that their stacking is offset towards the pressure side 16*a*, with this taking place progressively and increasingly for sections closer to the top 28*a'* (in the order S1, S2, S3, and S4 in FIG. 5).

"A" designates the outer limit of the free end of the pressure side rim 281', with this being referred to below as the end A of the pressure side rim 281'.

Furthermore, the rim 28' shown also has an enlargement 283' in the pressure side rim 281' at the location of the outer limit A of the free end of said pressure side rim 281', i.e. at the location of the margin of the pressure side at the top 28*a'*.

This enlargement 283' is present in some of the stacked sections (S3 and S4) of FIG. 5 and leads to the end A having a pointed shape in section, with the axis of the cooling channel 32 intersecting this pointed shape. This pointed shape, which appears during the machining of the blade 10, should be considered as being optional and not essential.

Figure 6:
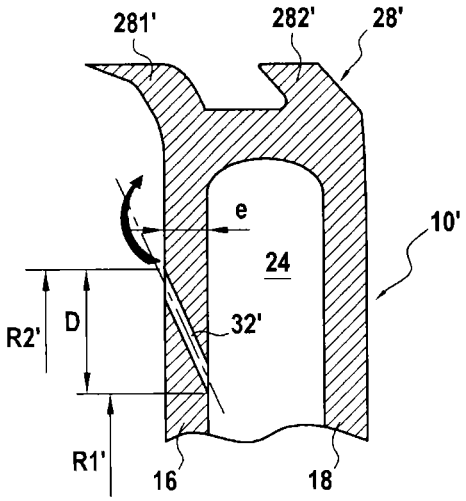
Figure 7:
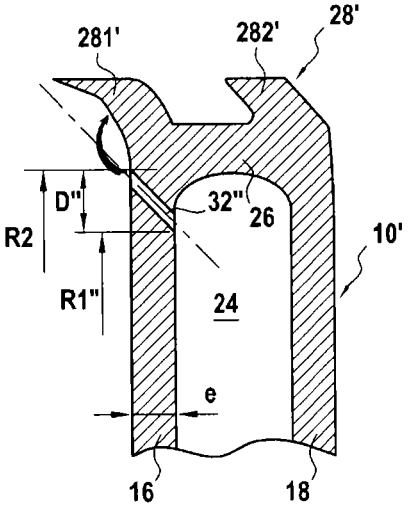

In order to mitigate this problem and to make a tip section offset compatible with holes under the bathtub, it is natural to modify the shape of the bathtub and thus to degrade its thermal efficiency:

a first solution, as shown in FIG. 6, has cooling channels 32' that are easily drilled, by reducing the height of the outlet radius R2 to the value R2' without modifying the total radial extent D (the height of the cooling channel inlet radius R1 is lowered to the value R1'); under such circumstances, by reducing the radius R2 and lowering the position of the outlets from the cooling channels, it is no longer possible to obtain satisfactory cooling of the blade tip formed by the rim 28'; and a second solution, as shown in FIG. 7, has cooling channels 32" that are easy to drill, and consists in reducing the total radial extent D to a value D" without changing the height of the outlet radius R2; under such circumstances, by increasing the radius R1 to a value R1", it is possible to obtain satisfactory cooling of the blade tip formed by the rim 28', but the phenomenon of thermal cooling by pumping is no longer sufficient, since it is effective over only a small portion of the blade along the axis R-R'.

In order to mitigate those drawbacks, the present invention proposes the solution presented in FIGS. 8 to 11 and described below.

The blade 110 has a rim 28' provided with a tip section offset as described above with reference to FIG. 5.

The pressure side wall 16 is modified in its intermediate portion that is adjacent to the pressure side rim 281', in that this intermediate portion forms a protrusion towards the pressure side 16*a*.

More precisely, the intermediate portion is a projecting portion 161 such that, in this projecting portion, the pressure side 16*a* is no longer directed in the longitudinal direction R-R', i.e. the radial direction, but slopes so as to depart progressively further from the suction side 18*a* on approaching the rim 28' in the longitudinal direction R-R'.

More than half the length of this projecting portion 161 extends along a longitudinal portion of the internal cooling passage 24 (specifically the radially outermost portion in the assembled engine).

By offsetting the pressure side wall 16 in this way where the hole is drilled, it is possible to conserve the radii R2 and R1 of FIG. 4 and to move the axis of the cooling channels 132 at the end A of the pressure side rim 281' far enough away to allow drilling to be undertaken.

This projecting portion 161 extends over the full height of the cooling channels 132 between the radii R2 and R1 (where R2>R1) and is visible on the pressure side 16*a* in the form of an outside face or pressure side face 161*a*, a terminal face 161*b* facing towards the rim 28', and an internal face 161*c* facing towards the internal cooling passage 24.

The pressure side face 161*a* of the projecting portion 161 slopes progressively away from the radial direction R-R' on approaching the terminal face 161*b*. The angle of inclination β formed between the pressure side face 161*a* of the projecting portion 161 and the longitudinal direction R-R', i.e. the radial direction, preferably lies in the range 10° to 60°, more preferably in the range 20° to 50°, and advantageously in the range 25° to 35°, in particular being close to 30°.

Furthermore, the angle of inclination α of the cooling channels 132 relative to the longitudinal direction R-R', i.e. the radial direction, lies in the range 10° to 60°, preferably in the range 20° to 50°, and advantageously in the range 25° to 35°, specifically being close to 30°.

With this configuration, a non-zero minimum distance d1 is available on measuring the difference d between the parallel to the longitudinal direction R-R' passing through the end A of the pressure side rim 281' and the end B or outer edge of the projecting portion 161 as situated between the pressure side face 161*a* and the terminal face 161*b*. In other words, the end B is set back relative to the end A.

Preferably, said minimum value d1 is greater than or equal to 1 millimeter (mm), or indeed 2 mm, and depends on the material used for performing the drilling of the cooling channels 132.

In characteristic manner, said cooling channels 132 are arranged in the projecting portion 161 so as to open out into the terminal face 161*b* of said projecting portion 161.

In this way, a stream of cooling air F1 is obtained (see FIG. 8) that is pushed back by the external flow of hot gas passing from the pressure side 16*a* towards the suction side 18*a* via the clearance that exists between the top of the blade and the corresponding inner annular surface of the turbine casing 50 as a result of the positive pressure gradient between the pressure side 16*a* and the suction side 18*a*.

This configuration generates a stream F2 in a recirculation zone (corner zone) that ensures effective mixing between the cooling gas stream F1 and the external hot gas, regardless of the position of the outlet openings of the cooling channels 132 in the terminal face 161*b* of said projecting portion 161.

Thus, the use of a projecting portion 161 of the invention makes it possible to further improve the effectiveness of the cooling generated by the air coming from the cooling channels 132.

In a preferred geometrical arrangement shown in FIGS. 8 to 11 the distance Δ (see FIG. 9) between the end B of the terminal face 161*b* of the projecting portion 161 and the remainder of the pressure side wall 16 is not less than the difference between firstly the offset E measured between the end A of the pressure side rim 281' and the remainder of the pressure side wall 16, and secondly said distance d between the axes of the cooling channels 132 and the end A of the pressure side rim 281'; this distance Δ corresponds to the axial extent of the terminal face 161*b* of said projecting portion 161. In other words:

$$\Delta \geq E - d.$$

In order to avoid increasing the weight of the structure, the thickness e of the pressure side wall 16 of the airfoil of the blade 110 is substantially constant both in the projecting portion 161 and in the remainder of the pressure side wall 16, and is also substantially equal to the thickness of the wall in the zone 161*d* of the projecting portion 161 (see FIG. 9) connected to the end wall level with and in front of the base of the pressure side rim 281'.

It should be observed that the wall thicknesses are considered along a direction orthogonal to the outside face of the zone under consideration.

Figure 9:
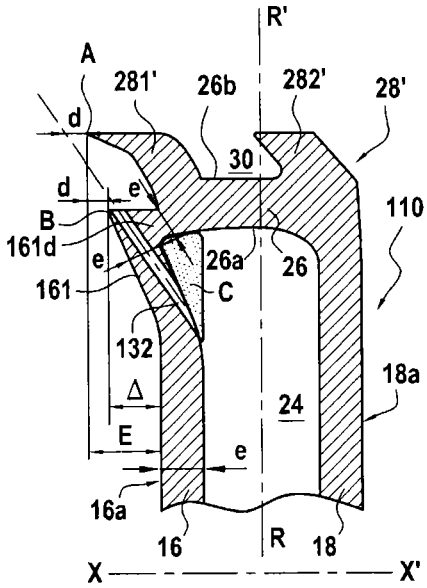

This characteristic is shown in FIG. 9, where this thickness e can be seen: below the projecting portion 161; at locations in the projecting portion 161 along the cooling channels 132; and in the zone 161*d* situated between the terminal face 161*b* and the internal cooling passage, and connecting the projecting portion 161 to the end wall 26.

In order to avoid penalizing the mechanical robustness of the blade root 12, it is necessary to avoid thickening the pressure side wall 16 at the location of the projecting portion 161. For this purpose, the rear face of the pressure side wall is cut away in the location of the projecting portion 161. Specifically, the zone to be removed behind the projecting portion 161 compared with the conventional profile for the pressure side wall 16 and represented by lines P1 and P2 in FIG. 8 corresponds to the shaded zone referenced C in FIG. 9.

Advantageously, this design in accordance with the invention with a projecting portion 161 that does not involve increasing wall thickness can be obtained with a minimum of modification to existing tooling; for casting, the already existing core box is dug into for a volume equivalent to the extruded surface C (across the entire width of the pressure side) so as to produce cores having the inside profile of the cavity suitable for obtaining the projecting portion 161, and this volume is dug away from the wax mold forming the outer envelope of the blade.

In this configuration, the outside face 161*a* and the inside face 161*c* of the projecting portion 161 are mutually parallel.

The terminal face 161*b* of the projecting portion 161 is preferably plane.

Figure 8:
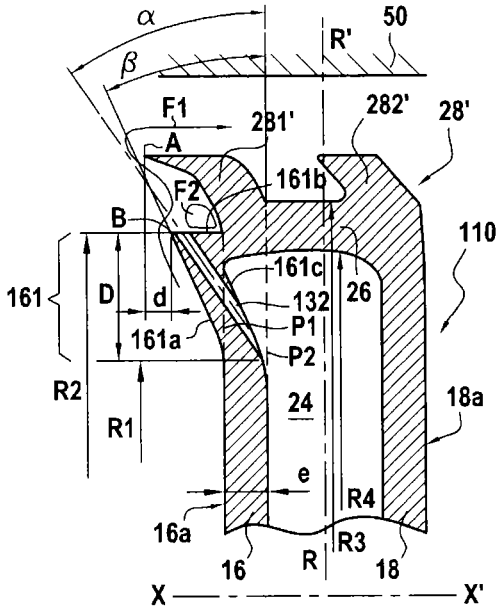
FIGS. 8 and 9 show the solution of the present invention.

In FIGS. 8 and 9, the terminal face 161*b* of the projecting portion 161 is horizontal; it is directed orthogonally to the longitudinal direction R-R' of the blade at the location where the cooling channels 132 open out into said terminal face 161*b*.

In the example shown, the entire terminal face 161*b* of the projecting portion 161 extends orthogonally to the longitudinal direction R-R' of the blade.

Figure 10:
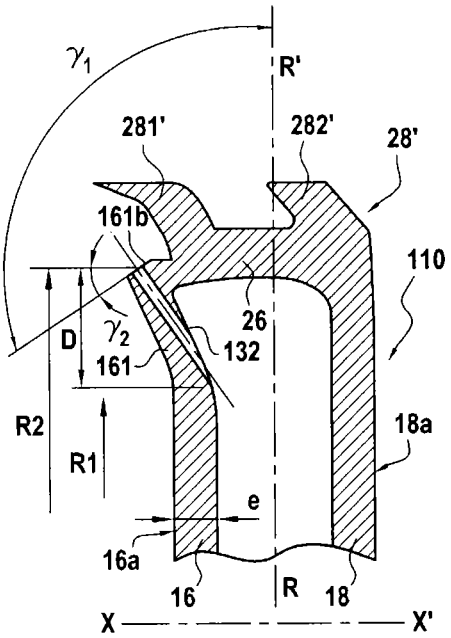
FIGS. 10 and 11 are views similar to the view of FIG. 8 for first and second variant embodiments.

In a first variant shown in FIG. 10, a chamfer is used at the terminal face 161*b*, so that the terminal face 161*b* of the projecting portion 161 is inclined so as to form a non-zero obtuse angle γ1 with the longitudinal direction R-R' of the blade at the location where the cooling channels 132 open out into said terminal face 161*b*. In this arrangement, an acute angle γ2 is formed between the terminal face 161*b* of the projecting portion 161 and the horizontal direction parallel to the rotary axis X-X' of the rotor and orthogonal to the longitudinal direction R-R' of the blade. This angle γ2 preferably lies in the range 10° to 60°, more preferably in the range 20° to 50°, and advantageously in the range 25° to 35°, and in particular it is close to 30°.

In this way, the axis of the cooling channels 132 is orthogonal to the terminal face 161*b* of the projecting portion 161 at the location where the cooling channels 132 open out into said terminal face 161*b*. The advantage of this variant is that the shape of the outlet openings of the cooling channels 132 in the terminal face 161*b* is round, in contrast to the more oval shape when the terminal face 161*b* is horizontal, thus making it possible to obtain better control over the outlet section of the cooling channels 132, and thus over the flow rate of cooling air.

In FIGS. 8 to 10, the end wall 26 extends orthogonally to the longitudinal direction R-R' of the blade, which corresponds to a conventional configuration.

Furthermore, in FIGS. 8 to 10, the terminal face 161*b* of the projecting portion 161 is arranged at the height of the outlet radius R2 that is less than the radius R3 corresponding to the outside face 26*b* of the end wall 26 (see FIGS. 8 and 9) that faces towards the cavity 30. Thus, R2<R3 serves to guarantee effective cooling of the bottom zone of the bathtub (if R2>R3, then the bottom of the bathtub would not be impacted by the cooling coming from the cooling channel 32).

Also, in these FIGS. 8 to 10, the terminal face 161*b* of the projecting portion 161 is located at the height of the outlet radius R2 that is greater than the radius R4 corresponding to the inside face 26*a* of the end wall 26 (see FIGS. 8 and 9) that faces towards the internal cooling passage 24. This situation with R2>R4 makes it possible to guarantee that the blade 110 is properly cooled above the zone that is not thermally covered by the cooling generated by the cavity 30.

Consequently, having R2<R3 and R2>R4 represents the best thermal compromise that can be found.

Figure 11:
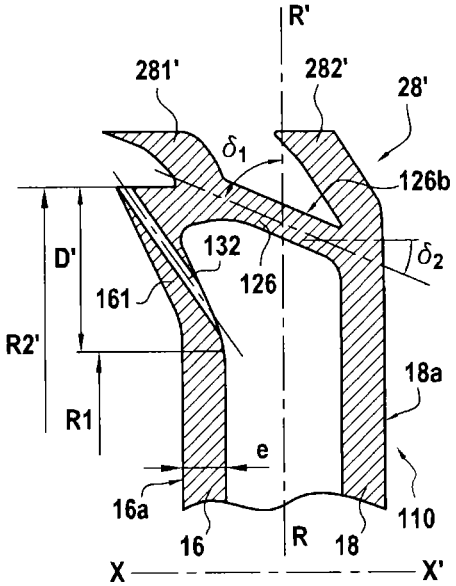

In the second variant of FIG. 11, a bathtub is used having a sloping bottom wall with the end wall 126 sloping to form an angle δ1 that is not a right angle and that is not zero relative to the longitudinal direction R-R' of the blade.

More precisely, the top face of said end wall 126 in the location adjacent to the pressure side rim 281' forms an acute angle δ1 that preferably lies in the range 45° to 89°, more preferably in the range 50° to 65°, and advantageously in the range 55° to 65°, specifically being close to 60°, which corresponds to an acute angle δ2 between the top face of said end wall 126 and the horizontal direction parallel to the axis of rotation X-X' of the rotor and orthogonal to the longitudinal direction R-R' of the blade.

The invention claimed is:

1. A hollow blade comprising:

an airfoil extending along a longitudinal direction;

a root;

a tip;

an internal cooling passage inside the airfoil;

a cavity situated in the tip, being open towards a free end of the blade and defined by an end wall and a rim, the rim extending between a leading edge and a trailing edge and including a suction side rim along a suction side and a pressure side rim along a pressure side;

cooling channels connecting the internal cooling passage with the pressure side, the cooling channels sloping relative to the pressure side;

a stack of airfoil sections of the blade at a level of the rim of the blade tip including an offset of both the suction side rim and the pressure side rim towards the pressure side, the offset increasing on approaching the free end of the tip of the blade, wherein the pressure side wall of the airfoil includes a projecting portion with more than half of its length extending along a longitudinal portion of the internal cooling passage, and with an outside face that slopes relative to a remainder of the pressure side of the airfoil, and including a terminal face at its end facing towards the rim, the end wall being connected to the pressure side wall at a location of the end of the projecting portion and the cooling channels being arranged in the projecting portion to open out in the terminal face of the projecting portion, wherein a distance between axes of the cooling channels and an outer limit of the free end of the pressure side rim is greater than or equal to a non-zero minimum value;

wherein a thickness of the pressure side wall of the airfoil is substantially constant in the projecting portion and in the remainder of the pressure side wall.

2. A blade according to claim 1, wherein the minimum value is greater than or equal to 1 mm.

3. A blade according to claim 1, wherein a distance between an end of the terminal face of the projecting portion and the remainder of the pressure side wall is not less than a difference between the offset measured between an end of the pressure side rim and the remainder of the pressure side wall and the distance between the axes of the cooling channels and the end of the pressure side rim.

4. A blade according to claim 1, wherein the outside face and an inside face of the projecting portion are mutually parallel.

5. A blade according to claim 1, wherein the terminal face of the projecting portion is planar.

6. A blade according to claim 5, wherein the terminal face of the projecting portion slopes to form a non-zero obtuse angle relative to the longitudinal direction of the blade at the location where the cooling channels open out into the terminal face.

7. A blade according to claim 6, wherein the axes of the cooling channels are orthogonal to the terminal face of the projecting portion at the location where the cooling channels open out into the terminal face.

8. A blade according to claim 1, wherein the end wall is arranged orthogonally relative to the longitudinal direction of the blade.

9. A blade according to claim 1, wherein the end wall extends along a slope to form a non-zero angle other than a right angle relative to the longitudinal direction of the blade.

10. A blade according to claim 1, wherein the cooling channels open out in a vicinity of an outer edge of the projecting portion.

11. A blade according to claim 1, wherein an angle of inclination of the cooling channels relative to the longitudinal direction is strictly greater than an angle of inclination formed between the outside face of the projecting portion and the longitudinal direction.

12. A turbine engine rotor comprising at least one blade according to claim 1.

13. A turbine engine turbine comprising at least one blade according to claim 1.

14. A turbine engine comprising at least one blade according to claim 1.

15. A blade according to claim 1, wherein the pressure side rim includes a first portion which is offset at a first angle, and a second portion which is closer to the free end of the tip of the blade than the first portion and which is offset at a second angle.

* * * * *